United States Patent [19]

Čurda et al.

[11] Patent Number: 4,710,646

[45] Date of Patent: Dec. 1, 1987

[54] THREAD MOVEMENT SENSOR

[75] Inventors: Otakar Čurda; Jaroslav Maxa; Pavel Uhlíř, all of Trebic, Czechoslovakia

[73] Assignee: Elitex koncern textilniho strojirenstvi, Liberec, Czechoslovakia

[21] Appl. No.: 847,499

[22] Filed: Apr. 3, 1986

[30] Foreign Application Priority Data

Apr. 3, 1985 [CS] Czechoslovakia ..... 2463-85

[51] Int. Cl.[4] ..... D01H 13/16; B65H 25/14; D03D 51/28; D01G 31/00

[52] U.S. Cl. ..... 307/116; 200/61.13; 200/61.14; 200/61.18; 340/677; 66/157; 66/158; 66/163; 66/166; 28/186; 28/187; 28/188; 28/189; 57/81; 307/117

[58] Field of Search ..... 307/116, 117; 200/61.13, 61.14, 61.18; 340/677; 226/11; 66/157, 158, 163, 166; 139/353, 354; 19/0.22, 0.25, 0.26; 28/186–189; 57/80, 81; 242/37 R

[56] References Cited

U.S. PATENT DOCUMENTS

| | | | |
|---|---|---|---|
| 3,521,265 | 7/1970 | Bancroft | 200/61.18 |
| 3,587,497 | 6/1971 | Beazley | 200/61.18 X |
| 3,602,727 | 8/1971 | Schwalm et al. | 66/157 X |
| 3,714,916 | 2/1973 | Saray | 200/61.18 X |
| 3,727,393 | 4/1973 | Mikulecky et al. | 200/61.18 X |
| 3,873,789 | 3/1975 | Ward | 200/61.18 X |
| 4,075,445 | 2/1978 | Kempf | 66/163 X |
| 4,259,852 | 4/1981 | Jacobsson | 200/61.18 X |
| 4,455,549 | 6/1984 | Rydborn | 226/11 X |
| 4,525,705 | 6/1985 | Edmë et al. | 66/163 X |
| 4,551,591 | 11/1985 | Jones | 66/163 X |

*Primary Examiner*—William M. Shoop, Jr.
*Assistant Examiner*—Sharon D. Logan

[57] ABSTRACT

The invention relates to a thread movement sensor comprising an arm with at least one thread guide. The invention solves the problem of sensitivity of the sensor to the vibrations of the machine by making a part of the arm an element of a magnetic circuit of coil, the latter being connected to the control circuit of a knitting machine.

5 Claims, 6 Drawing Figures

THREAD MOVEMENT SENSOR

BACKGROUND OF THE INVENTION

This invention relates to a thread movement sensor, comprising an arm with at least one thread guide.

There are known small diameter circular knitting machines which are provided with mechanical tension sensors. In such devices, in a certain zone of knitting of the fabric, the presence or the movement of the thread is detected by displacement of contact wires, which in case the thread is broken, closes an electric circuit whereby to cause a switching-off of the motor of the machine drive. The disadvantage of such known sensor is its unreliability of switching due to dust and oxidation of the contacts, and further the necessity of mechanical adjustment when placing the sensor in operation.

Further, there are known sensors which detect the movement of the thread by means of piezo-ceramic bimorph elements, which detect vibrations caused by the movement of the thread and in case of the stoppage of the thread this condition is registered by an electronic circuit. The disadvantage of these sensors is their sensitivity to vibrations, which are transmitted from the machine or from its surroundings. In addition, such sensors are quite costly.

SUMMARY OF THE INVENTION

The present invention has among its objects the elimination of the above outlined disadvantages of prior art sensors. Such object is substantially achieved by the sensor of the present invention, in which a part of the arm over which the thread travels is an element of a magnetic circuit of a coil which is connected with the control circuit of the machine, such as a knitting machine.

The advantage of the device of the invention is that the use of a magnetic circuit in the input thereof guarantees an input sensitivity within a sufficiently small range of tolerances. Further, said sensors are less sensitive to spurious vibrations of the bobbin with respect to lower mechanical frequencies of the mechanism, converting the non-uniform thread tension to a change of magnetic flux. Further, the sensors of the invention are substantially cheaper to manufacture than those of the prior art.

BRIEF DESCRIPTION OF THE DRAWING

The device, according to the invention and exemplary embodiments thereof, is illustrated in the drawings, wherein.

Figure 1:
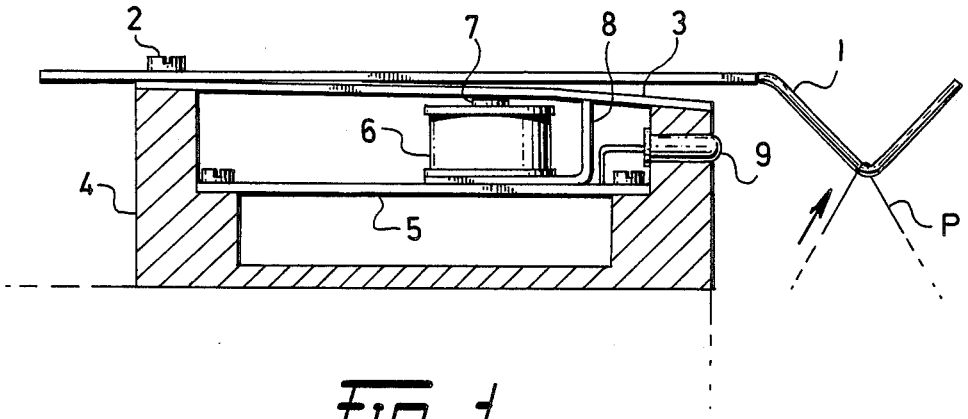
FIG. 1 is a view partially in side elevation and partially in section of a first embodiment of the sensor of the invention, the sensor being shown in the position assumed by its parts when a thin thread is being used in the related machine.
Figure 3:
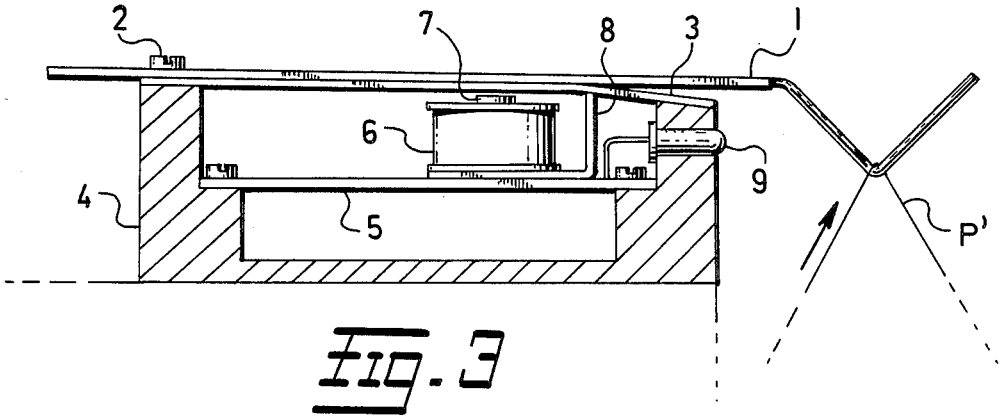
FIG. 3 is a view similar to that of FIG. 1, but with the sensor being acted upon by a thick thread.

Figures, 4, 5, and 6 are views similar to those of FIGS. 1 and 3, but showing, respectively, three other embodiments of the device of the invention.

DESCRIPTION OF THE PREFERRED EMBODIMENTS

Turning first to FIG. 1, a resilient arm 1 is provided with a bend over which bend the thread P is fed, the arm 1 is fixed at one end by suitable means e.g. screw 2 to the cover 3 of a carrying body 4 of the sensor. The surface of the cover 3 is curved so that from the point of its fixing to the body 4 it curves downwardly from the horizontal in the direction of the pull of the thread P. The free end of the arm 1, near the bend therein is spaced an appreciable distance above the cover 3. Inside of the body 4 of the sensor there is a plate 5, which is fixed, e.g. by screws, to the body 4. Fixed upon the upper surface of the plate 5 there is a coil 6. Inside the coil 6 there is a permanent magnet 7. The lower end of the coil 6 and of the permanent magnet 7 are provided with an L-shaped armature 8, the upper end of which engages the lower surface of the cover 3. In this way, movements of the arm 1 cause changes in the magnetic flux of coil 6. In the body 4 there is also mounted an LED 9 which indicates the condition of the signal in the output of the circuit (FIG. 2), which processes the signal of the magnetic flux of the coil 6.

Figure 2:
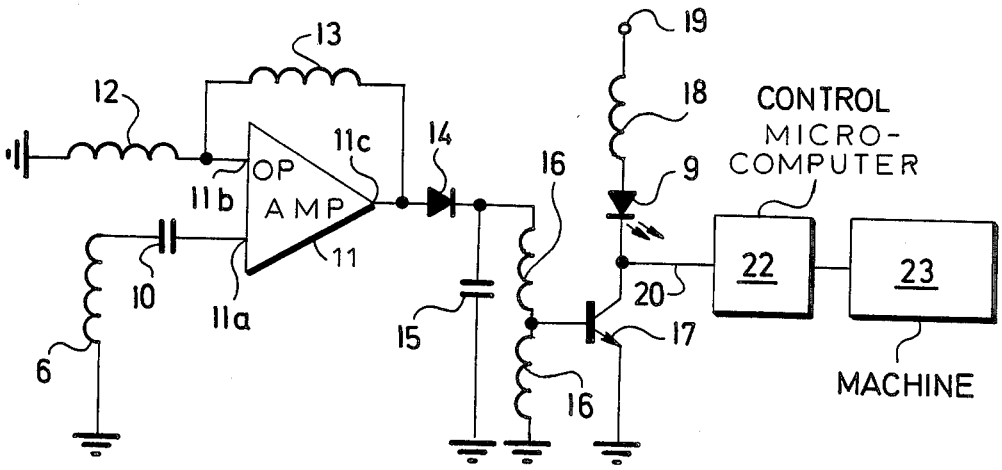
FIG. 2 is a schematic wiring diagram of the electric circuit which evaluates the signals emitted by the sensor of FIG. 1.

Turning now to FIG. 2, interposed between the upper end of the coil 6 and the non-inverting input 11*a* of an operational amplifier 11 there is a separating capacitor 10. To the inverting input 11*b* of the amplifier 11 there are connected impedances 12 and 13, such impedances forming a feedback circuit. To the outlet 11*c* of the amplifier 11 there is connected a rectifying diode 14 being further connected to a filtering capacitor 15 and a voltage divider 16 consisting of two impedances. Between the impedances of the divider 16 there extends a connection to the base of NPN transistor 17, the collector of which is connected to the indicating LED 9. LED 9 in turn is connected through its operation resistor 18 to a power supply terminal 19 for the circuit. A cable 20 extends from the collector of the transistor 17 to a microcomputer control device 22, control device 22 being connected, as shown, to the machine 23, which in this case is a knitting machine.

The above-described device operates as follows: During knitting, the thread is fed over the bend of the arm 1, while due to the tension of the thread P, the arm 1 is deflected downwardly and adapts itself according to the surface of the cover 3. Due to the change of the tensile force in the thread P during its unwinding from a bobbin, a vibration or swinging of the arm 1 takes place. Because a part of the arm 1 is in the field of magnetic flux of the circuit consisting of the coil, permanent magnet 7, and armature 8 , the vibration of the arm 1 causes a change in the magnetic flux to take place. If the amplitude of said flux is larger than that during which the electronic circuit of the sensor does not respond, stopping of the machine 23 takes place by a command from the control microcomputer 22, which is connected to the sensor by the connector 20. Vibration of the arm 1 causes creation of alternating current in the coil 6, the current being fed through the separating capacitor 10 to the non-inverting input 11*a* of the amplifier 11. The amplification of the amplifier 11 is adjustable, depending upon the choice of the values of the impedances 12 and 13 which comprise the feedback circuit. The output voltage is fed from the connector of the output 11*c* of the amplifier 11 to recifying diode 14, which rectifies the output voltage and charges the filtering capacitor 15.

Filtering capacitor 15 with resistance voltage divider 16 forms a time constant, which is selected according to the requirement for processing the signal output delivered by the sensor through the connector 20. The time constant thus determines when the thread moves or when it is fed to the needles of the machine 23. At the same time, the collector of the transistor 17 also supplies voltage to the indicating LED 9, which visually indicates when the thread P is not being supplied to the machine 23.

FIG. 3 shows the condition of the sensor of FIG. 1 when a thick thread P' is being fed to the machine. Due to the greater tension of the thick thread in this case, the arm 1 is bent further downwardly toward the cover 3 than it is in FIG. 1. Thus, a greater length of the arm 1 conforms to the shape of the cover. The part of the arm 1, which is in the field of magnetic flux of the coil 6 and the magnet 7, also vibrates as in the case discussed above in connection with FIG. 1, and so there is no difference in the function of the sensors shown in FIGS. 1 and 3. The arrangement of such sensors has the advantage that it operates without adjustment with any force induced by the thread or with various tensile forces in the thread.

Figure 4:
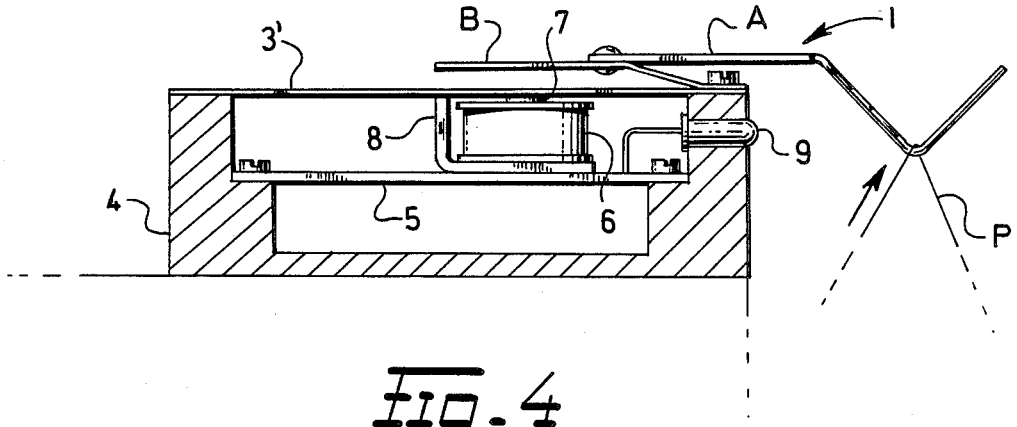
Figure 5:
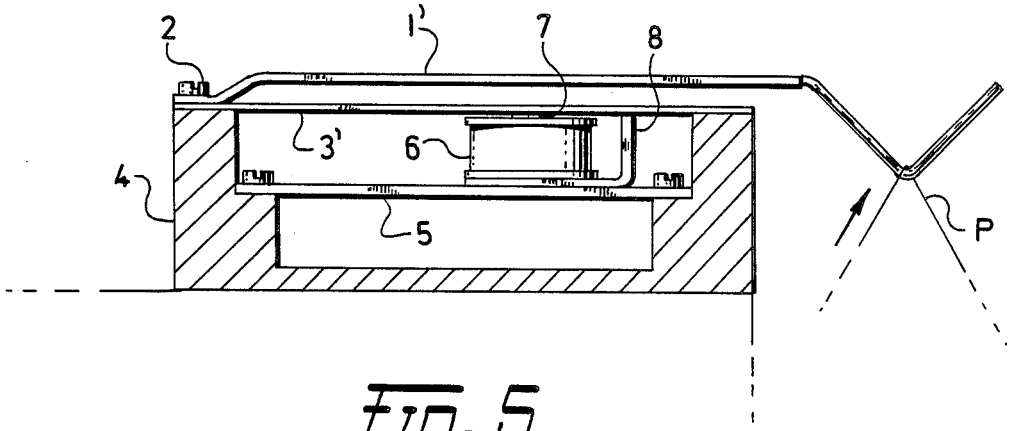

There are various further embodiments of the sensor within the scope of the invention. In the main, such embodiments differ from that of FIGS. 1 and 3 by the manner of mounting of the arm 1. In FIG. 4, for example, an elastic part B is fixed to nonelastic part A of the arm, said elastic part B being in the field of magnetic flux of the coil 6, the magnet 7, and the armature 8, cover 3' in this case being flat, as shown. In the embodiment of FIG. 5, the arrangement is the same except for the manner of mounting of the arm 1'. The arm 1' has a downward bend where it is attached to the body 4 at its left-hand end, and is straight and spaced above the cover 3' until it reaches the bend therein.

Figure 6:
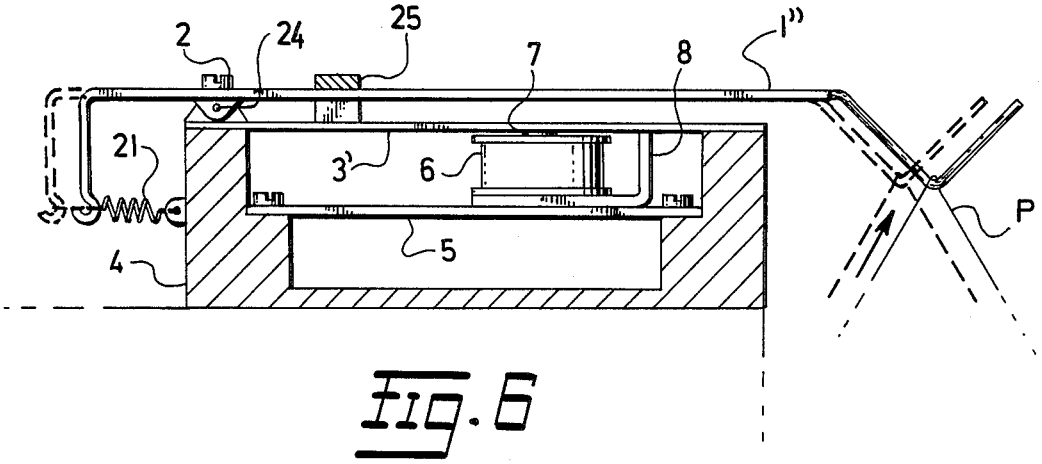

In the embodiment of FIG. 6, the arm 1'' is pivotally mounted to the body 4 adjacent its left-hand end at the mounting means 24. A downward bend in the arm 1'' is provided with a hook at its lower end, such hook being connected to the body 4 by a coil tension spring 21. In its idle position, the arm 1'' is stopped in its upper, full line position, by engagement with a fixed member 25, which overlies the arm. By slackening the screw 2, which secures the arm 1'' to the pivotal mounting means 24, the arm can move horizontally as illustrated by the dashed lines in FIG. 6, and by tensioning of the spring 21, it is possible to control a force necessary to swing the arm 1 with respect to the thickness or tension in the thread P.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Device for detecting the presence and movement of a thread under tension and for stopping a thread manipulating machine when the tension of the thread changes by a predetermined desired amount comprising an arm having a thread guide at one end and being fixed at its other end to a body, said body containing a coil wherein said arm and said coil form part of a magnetic circuit, such that movement of said arm results in a change in the magnetic flux of said magnetic circuit, said thread passing over said thread guide so as to deflect said arm with respect to said coil whereby said arm and said coil function as a contactless switch to signal movement of the arm by providing a corresponding change in the magnetic flux of the coil such that the magnitude of any change in flux of said coil corresponds to the magnitude of any movement of the arm, the movement of the arm thereby being able to be measured electronically by measuring the change in the magnetic flux of the coil.

2. The device of claim 1, wherein the coil has a permanent magnet core.

3. The device of claim 2, wherein the body is provided with a cover separating said coil and said arm, said cover curving away from said arm in the direction of said thread guide.

4. The device of claim 2, wherein the coil has a substantially L-shaped armature which extends from the end of said coil being farthest from said arm.

5. The device of claim 1, wherein said coil is electrically connected to a circuit, said circuit comprising an amplifier having a feedback control, the coil being connected to the input of the amplifier, the output of the amplifier being connected through a rectifying diode, to a filtering capacitor and to a resistance voltage divider, the midpoint of the voltage divider being connected to the base of an NPN transistor, the collector of the transistor being connected on the one hand, through an LED to a power source and, on the other hand to a control for a textile machine.

* * * * *